US009739568B2

(12) United States Patent
Dominguez

(10) Patent No.: US 9,739,568 B2
(45) Date of Patent: Aug. 22, 2017

(54) METHODS OF CONNECTING TESTING EQUIPMENT TO A MISSILE SYSTEM

(71) Applicant: THE BOEING COMPANY, Chicago, IL (US)

(72) Inventor: Kevin Dominguez, Anaheim Hills, CA (US)

(73) Assignee: The Boeing Company, Chicago, IL (US)

( * ) Notice: Subject to any disclaimer, the term of this patent is extended or adjusted under 35 U.S.C. 154(b) by 172 days.

(21) Appl. No.: 14/850,141

(22) Filed: Sep. 10, 2015

(65) Prior Publication Data

US 2017/0074619 A1 Mar. 16, 2017

(51) Int. Cl.

| | |
|---|---|
| ***F41G 7/00*** | (2006.01) |
| ***F42B 15/01*** | (2006.01) |
| ***F42B 35/00*** | (2006.01) |
| *F42B 15/00* | (2006.01) |

(52) U.S. Cl.

CPC ..... *F41G 7/001* (2013.01); *F42B 15/01* (2013.01); *F42B 35/00* (2013.01)

(58) Field of Classification Search

CPC ..... F41G 7/001; F41G 7/005; F42B 15/01; F42B 35/00; F42B 15/08; F42B 39/24; G01C 21/10; G01C 21/12; G01C 21/16

See application file for complete search history.

(56) References Cited

U.S. PATENT DOCUMENTS

| | | | | |
|---|---|---|---|---|
| 2,635,033 | A * | 4/1953 | Higgs | F42B 35/00 346/124 |
| 3,285,400 | A * | 11/1966 | High | F42B 39/24 206/207 |
| 3,351,307 | A * | 11/1967 | Poncel | F42B 15/08 244/173.2 |
| 4,685,188 | A | 8/1987 | Goy | |
| 4,743,138 | A | 5/1988 | Goy | |
| 5,521,951 | A | 5/1996 | Charnley | |
| 7,610,783 | B2 | 11/2009 | Rudduck | |
| 2003/0192996 | A1* | 10/2003 | Jacobs | G01C 21/16 244/164 |
| 2012/0153070 | A1* | 6/2012 | Janiak | F42B 15/01 244/3.1 |

* cited by examiner

*Primary Examiner* — Bernarr Gregory
(74) *Attorney, Agent, or Firm* — Joseph M. Butscher; The Small Patent Law Group, LLC

(57) ABSTRACT

A missile system includes a plurality of components, and a testing instrumentation platform secured within at least one of the plurality of components. The testing instrumentation platform is secured within the component(s) through at least one platform supporting adapter assembly. The platform supporting adapter assembly may include an adapter having a planar panel that supports one or more fasteners. The fastener(s) are configured to securely connect to a portion of a base of the testing instrumentation platform. At least one through-hole may be formed through a portion of the adapter. At least one tapered bolt is configured to be securely retained within the through-hole(s). The tapered bolt(s) securely connects the adapter to the component(s).

18 Claims, 6 Drawing Sheets

METHODS OF CONNECTING TESTING EQUIPMENT TO A MISSILE SYSTEM

FIELD OF THE DISCLOSURE

Embodiments of the present disclosure generally relate to methods of connecting testing equipment to a missile system, such as through one or more platform supporting adapter assemblies.

BACKGROUND OF THE DISCLOSURE

A known missile system includes a plurality of rocket or booster stages that are used to power the missile system into and/or above the atmosphere. For example, a first stage is activated to launch the missile system out of a silo. After a first time period after the launch (such as sixty seconds), the first stage separates from the missile system and falls back to Earth. As the first stage separates, a second stage activates. After a second time period after launch, the second stage separates and falls back to Earth, while a third stage activates. After a third time period after launch, the third stage deactivates, and a post-boost vehicle separates from the third stage. The post-boost vehicle maneuvers and prepares a re-entry system (RS) for deployment. The RS may be armed with ordnance and is guided to a target.

The post-boost vehicle may include a propulsion system rocket engine (PSRE) positioned below a missile guidance set or system (MGS). In order to test a type of missile system, a separate and distinct instrumentation stage is positioned between the MGS and the RS of a test missile system. The instrumentation stage may include various components, such as a telemetry system, a computer, command-destruct devices, batteries, and the like. The instrumentation stage is configured to communicate with a base (such as a ground control station) to provide flight data, images, and/or the like to the base. The instrumentation stage is used to provide test data regarding the missile system. Further, the command-destruct devices may be activated through one or more signals received from the base to destroy the RV if it veers off a desired course during a test.

In general, the instrumentation stage includes an outer annular wall that is secured between the MGS and the RS. A known instrumentation stage includes a separate and distinct seven inch ring layer between the MGS and the RS. Notably, however, the separate and distinct wall of the instrumentation stage adds size and weight to the missile system, which may cause the missile system to operate in a different manner than a missile system without such testing equipment. Moreover, connecting the separate and distinct instrumentation stage between the MSG and the RS is time and labor and intensive, as the instrumentation stage needs to be affixed to different components of the missile system (for example, separately bolted to an RS and an MGS).

SUMMARY OF THE DISCLOSURE

A need exists for a smaller and lighter missile system that includes testing equipment. Further, a need exists for a missile system into which testing equipment (such as a testing instrumentation platform) may be efficiently secured.

With that in mind, certain embodiments of the present disclosure provide a missile system that may include a plurality of components, and testing equipment such as a testing instrumentation platform secured within at least one of the components, such as at least one of a missile guidance set (MGS), a propulsion system rocket engine (PSRE), or a reentry system (RS). The testing instrumentation platform may be completely enclosed by the component(s). The missile system may also include a main assembly that includes at least one booster stage.

The testing instrumentation platform may be secured within the component(s) through at least one platform supporting adapter assembly. The platform supporting adapter assembly may include an adapter having a planar panel that supports one or more fasteners, which are configured to securely connect to a portion of a base of the testing instrumentation platform. At least one through-hole may be formed through a portion of the adapter. At least one tapered bolt is configured to be securely retained within the through-hole(s). The tapered bolt(s) securely connects the adapter to the component(s).

The platform supporting adapter assembly may also include at least one connection block extending from a portion of the planar panel. The through-hole(s) may be formed through the connection block.

The platform may also include a central protuberance that is configured to align the platform supporting adapter assembly with the component(s). The central protuberance may include a ramp connected to a shoulder.

The tapered bolt may be longer than a standard bolt used to connect the component(s) to another of the components. In at least one embodiment, the tapered bolt may include a head connected to a threaded portion, and a tapered pin extending from the threaded portion. The tapered pin may downwardly taper from a root to a distal tip. The tapered pin may be configured to be received and locked within a reciprocally-shaped portion of the through-hole.

The platform supporting adapter assembly may also include at least one isolator coupled to the fastener(s). The portion of the base of the testing instrumentation platform may abut the isolator(s).

Certain embodiments of the present disclosure provide a platform supporting adapter assembly configured to securely support a testing instrumentation platform within or more components of a missile system. The platform supporting adapter assembly may include an adapter having a planar panel that supports one or more fasteners. The fastener(s) are configured to securely connect to a portion of a base of the testing instrumentation platform. At least one through-hole may be formed through a portion of the adapter. At least one tapered bolt is configured to be securely retained within the through-hole(s). The tapered bolt(s) is configured to securely connect the adapter to the component(s).

DETAILED DESCRIPTION OF THE DISCLOSURE

Figure 1:
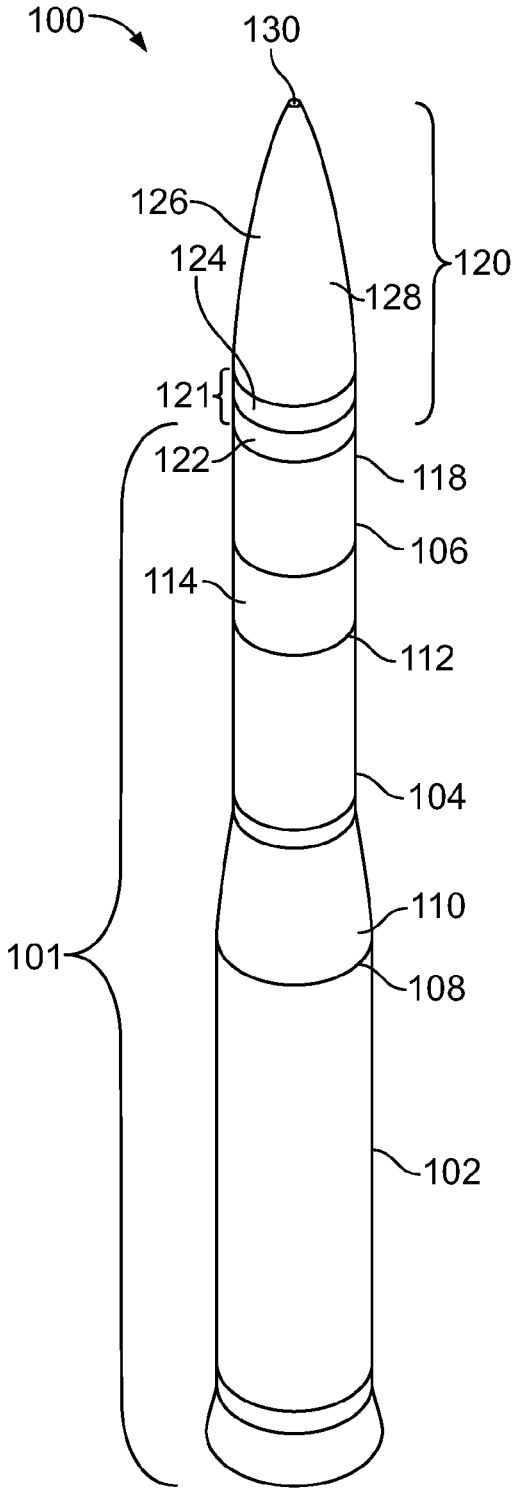
FIG. 1 illustrates a perspective front view of a missile system, according to an embodiment of the present disclosure.

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a method of mounting a secondary component or structure (such as an instrumentation platform) to a bolted interface that that may join adjacent primary components or structures together. The adjacent primary components may be, for example, a reentry system (RS) and a missile guidance set (MGS) of a missile system. In at least one other embodiment, the adjacent primary components may be a MSG and a propulsion system rocket engine (PSRE). Embodiments of the present disclosure may be used to secure one component of a missile system within another component, thereby reducing a size and weight of the missile system.

In at least one embodiment, a bolted interface between adjacent components of a missile system may include over one hundred bolts. Bolts may be removed and replaced with bolts that may include one or more taper pins at the distal ends of bolts. The tapered pins may mate with a receptacle or adapter in a secondary structure.

Embodiments of the present disclosure may adapt to an existing primary component or structure. That is, the primary component itself need not be modified. The secondary component may be connected to the primary structure using the existing bolted interface of the primary component.

Certain embodiments of the present disclosure provide an attachment interface that may include one or more platform supporting adapter assemblies. The attachment interface may be used to connect a circular structural member (a "platform" or "wafer") for supporting flight test equipment and a surrounding cylindrical rocket body. For example, a circumferential, radially symmetric bolt pattern may be disposed at a joint between rocket body cylinders. The bolt pattern is used to connect the cylinders together. The bolt heads are on the exterior of the rocket and the shanks or shafts point inward. Embodiments of the present disclosure may utilize certain bolt locations for supporting the wafer by extending their shaft to a length beyond the nut on the interior of the rocket body (that is, the bolts may be elongated, and may be substantially longer than standard bolts that are used to connect the cylinders together). The elongated shafts may slidably interface with an adapter, which, in turn, rigidly interfaces with the wafer to provide support. Each of the elongated shafts may be free to axially slide relative to the adapter such that the wafer is not overly constrained and is essentially free to expand and contract within the cylindrical rocket body.

Certain embodiments of the present disclosure provide an equipment support apparatus or platform supporting adapter assembly that may include a plurality of elongated bolts, a plurality of adapter members and a wafer or platform. Each of the elongated bolts may have a longitudinal axis that is radially oriented with an elongated shaft portion. Each of the elongated shaft portions may slidably engage an adapter portion, which may be rigidly connected to the wafer. The wafer may be free to expand or contract radially within the rocket body. The wafer or platform may include or otherwise support mounted flight test equipment. The wafer and the flight test equipment may be removable during a mission.

Certain embodiments of the present disclosure provide a method of temporarily installing flight test equipment that may include utilizing a radially symmetric bolt pattern of a joint within a missile component and/or between adjacent sections of missile components for mounting of a wafer platform for attachment of flight test hardware.

Embodiments of the present disclosure provide a method of quickly and efficiently securing an instrumentation platform or other such temporary flight test equipment to a missile system that may be easily adapted to an existing missile system with minimal design changes. Further, the instrumentation platform may be secured within an existing component of the missile system, thereby rendering more reliable test data, as an outer mold line of the missile system is not changed. That is, a missile system being tested is the same size and shape as others that are not being tested, and will therefore perform more like the actual missile systems (without testing equipment) that are to be used at a later date.

FIG. 1 illustrates a perspective front view of a missile system 100, according to an embodiment of the present disclosure. The missile system 100 may include a main assembly 101 that includes a first booster stage or first stage 102 connected to a second booster stage or second stage 104, which, in turn, connects to a third booster stage or third stage 106. Each of the stages 102, 104, and 106 may include cylindrically-shaped outer walls. An upper end 108 of the first stage 102 connects to a lower end 110 of the second stage 104. An upper end 112 of the second stage 104 connects to a lower end 114 of the third stage 106. Each of the stages 102, 104, and 106 may include a motor and a fuel tank, for example. The fuel tank may be configured to store rocket fuel, or other such propellant. The missile system 100 may include more or less than the three stages 102, 104, and 106. For example, the missile system 100 may include a single stage, or two stages. In at least one other embodiment, the missile system 100 may include four or more stages.

A post-boost vehicle 120 is secured to the main assembly 101. For example, the post-boost vehicle 120 may be mounted to an upper end 118 of the third stage 106 of the main assembly 101. The post-boost vehicle 120 may include a post boost control system 121 that includes a propulsion system rocket engine (PSRE) 122 coupled to a missile guidance set or system (MGS) 124. The post boost control system 121 connects to a reentry system (RS) 126 that may include a flight shroud 128 connected to ordnance 130.

Instead of mounting and securing a separate and distinct testing equipment layer (such as a testing instrumentation layer) between and to each of the MGS 124 and the RS 126, testing equipment (such as a testing instrumentation platform) is secured within a component of the missile system 100. For example, the testing instrumentation platform may be secured within the MGS 124, the PSRE 122, or the RS 126. In at least one embodiment, the testing equipment layer may be disposed at an interface between the MGS 124 and the RS 126, and may have portions contained within each of the MSG 124 and the RS 126.

It is to be understood that the missile system 100 shown in FIG. 1 is merely an example. It is to be understood that the missile system 100 may have various other shapes and sizes, and/or more or less components other than shown.

Figure 2:
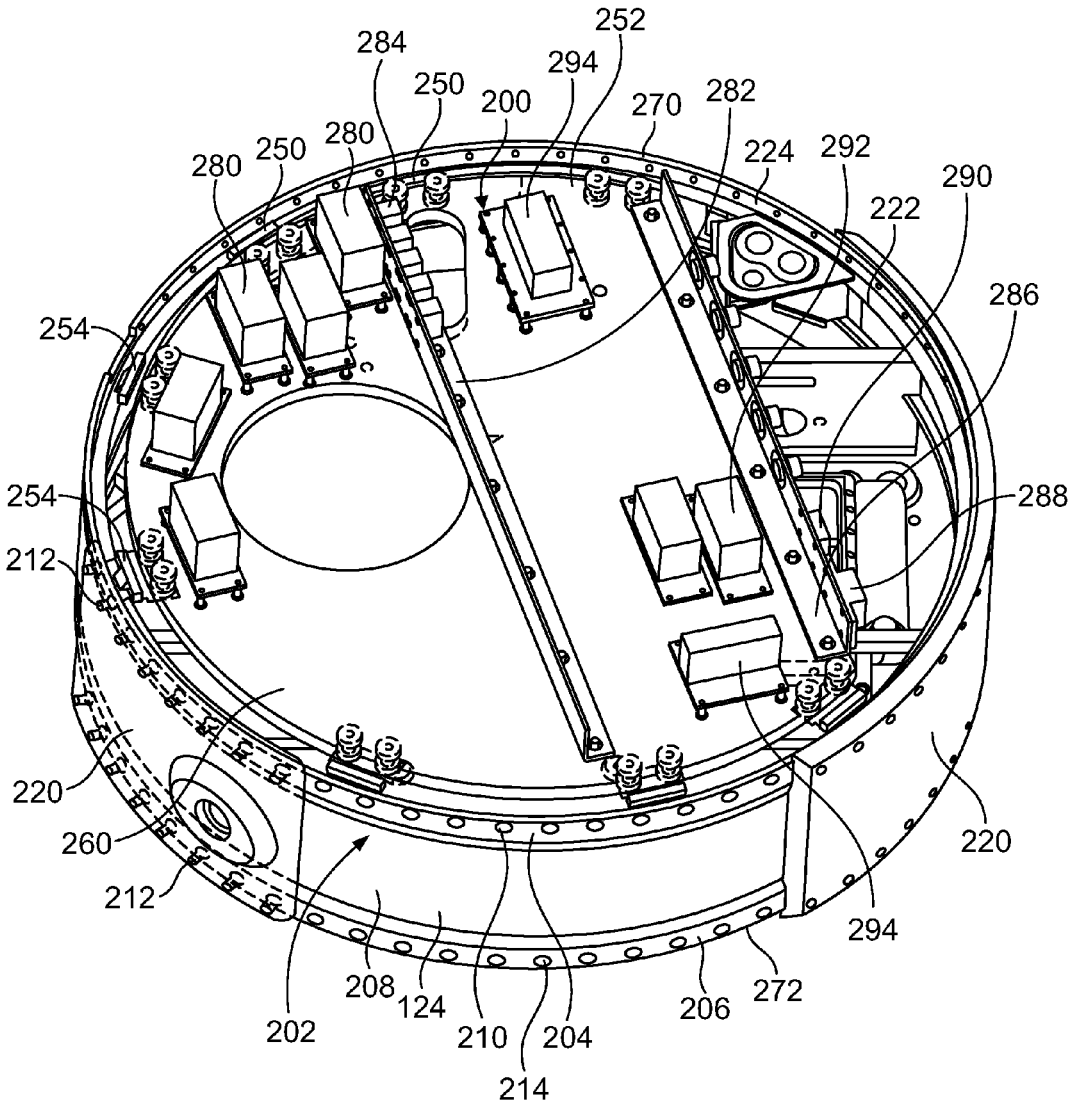
FIG. 2 illustrates a perspective top view of a testing instrumentation platform secured within a missile guidance set, according to an embodiment of the present disclosure.

FIG. 2 illustrates a perspective top view of a testing instrumentation platform 200 secured within the MGS 124, according to an embodiment of the present disclosure. The MGS 124 includes an outer circumferential wall 202 having an upper connection rim 204 connected to a lower connection rim 206 through an intermediate body 208. The upper connection rim 204 includes a plurality of fastener through-holes 210. Each of the fastener through-holes 210 is configured to receive a bolt 212 that is used to securely connect the MGS 124 to a lower portion of the post-boost vehicle 120 (shown in FIG. 1). Similarly, the lower connection rim 206 includes a plurality of fastener through-holes 214. Each of the fastener through-holes 214 is configured to receive a bolt that is used to securely connect the MGS 124 to an upper end of the PSRE 122 (shown in FIG. 1). Antennas 220 may be secured to an outer surface of the wall 202 through bolts 212.

As shown, an annular flange 222 may inwardly extend from an interior surface 224 of the wall 202. The testing instrumentation platform 200 securely connects to the annular flange 222 through a plurality of platform supporting adapter assemblies 250. The platform securing adapters assemblies 250 securely suspend the testing instrumentation platform 200 within at least a portion of an interior chamber 252 of the MGS 124 defined by the interior surface 224 of the wall 202.

The platform supporting adapter assemblies 250 securely connect to the annular flange 222 through elongated bolts (which are longer than the standard bolts 212 that are used to connect the MGS 124 to the RS 126) that extend through certain through holes 214 and into an adapter 254, which may be formed of a metal, such as aluminum, for example. In turn, the adapter 254 securely connects to and supports a circumferential base 260 through fasteners, such as bolts, pins, screws, and/or the like. The base 260 may be formed of various materials, such as metals, plastics, and the like. In at least one embodiment, the base 260 may be formed of a composite material having an outer skin and honeycomb pattern core.

As shown, the platform supporting adapter assemblies 250 may be regularly spaced about the annular flange 222. For example, neighboring (that is, closest) platform supporting adapter assemblies 250 may be spaced 45° with respect to one another. Alternatively, the neighboring platform adapter assemblies 250 may be spaced at intervals that are greater or lesser than 45°. More or less platform supporting adapter assemblies 250 than shown may be used to secure the testing instrumentation platform 200 within the MGS 124. Also, alternatively, the platform supporting adapter assemblies 250 may connect the testing instrumentation platform 200 to a lower annular flange proximate to the lower connection rim 206.

The testing instrumentation platform 200 may be mounted entirely within the interior chamber 252 such that the testing instrumentation platform 200 does not upwardly extend past an upper edge 270 of the wall 202, or below a lower edge 272 of the wall 202. In at least one other embodiment, portions of the testing instrumentation platform 200 may be supported above the upper edge 270 and/or below the lower edge 272, and may be configured to be positioned within an interior chamber of the post-boost vehicle 120 and/or an interior chamber of the PSRE 122 (shown in FIG. 1). Further, while shown within the MGS 124, the platform supporting adapter assemblies 250 may optionally be used to securely mount the testing instrumentation platform 200 within at least a portion of the PSRE 122, and/or the post-boost vehicle 120.

The base 260 of the testing instrumentation platform 200 may include a planar sheet having a circular axial cross-section. The base 260 may support one or more batteries 280, a rack 282 that supports one or more switches 284, a rack 286 that supports an RF coupler 288, an S-band transmitter 290, one or more command-destruct devices 292, and one or more computers 294 that are configured to control operation of the testing instrumentation platform 200.

In operation, the testing instrumentation platform 200 is used to communicate with a remote location (such as a ground control station). The testing instrumentation platform 200 is configured to transmit test data to the remote location. The testing instrumentation platform 200 may also receive signals from the remote location related to testing, command and destruct, and/or the like.

The testing instrumentation platform 200 and the MGS 124 shown in FIG. 2 may include more or less components than shown in FIG. 2. Further, the components of each of the instrumentation platform 200 and the MGS 124 may be arranged in different positions and orientations other than shown.

Figure 3:
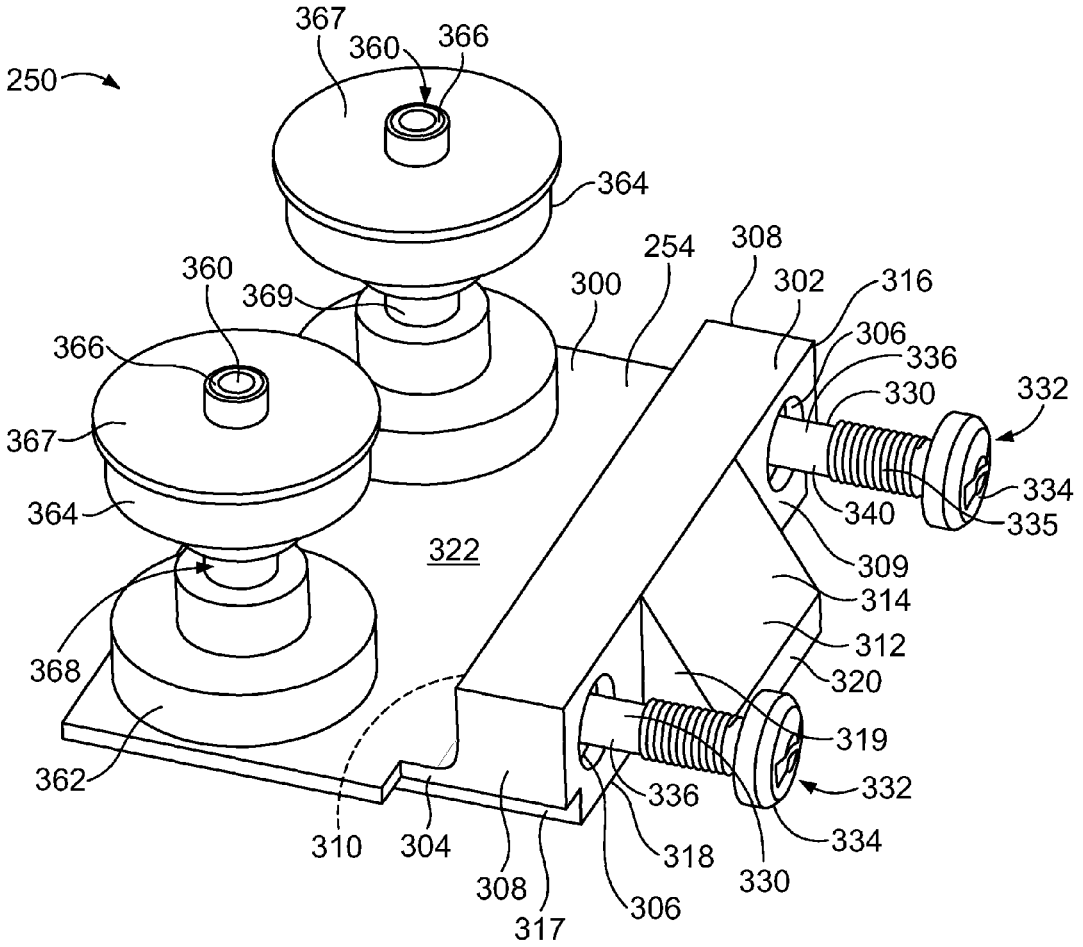
FIG. 3 illustrates a perspective top view of a platform supporting adapter assembly, according to an embodiment of the present disclosure.
Figure 4:
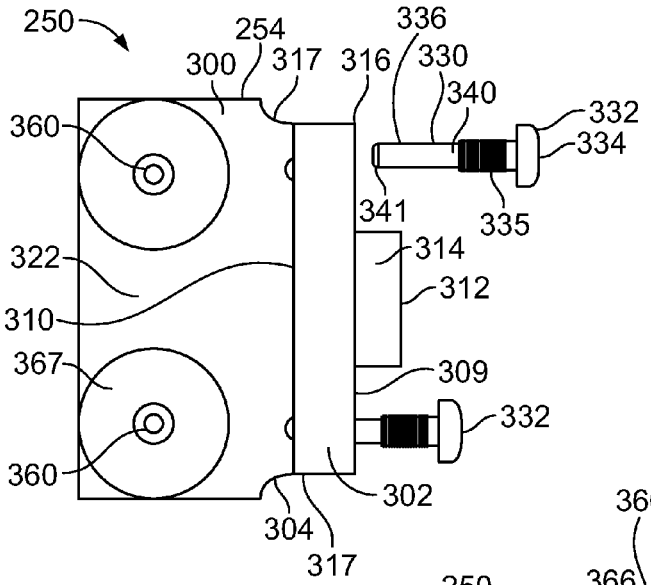
FIG. 4 illustrates a top view of a platform supporting adapter assembly, according to an embodiment of the present disclosure.
Figure 5:
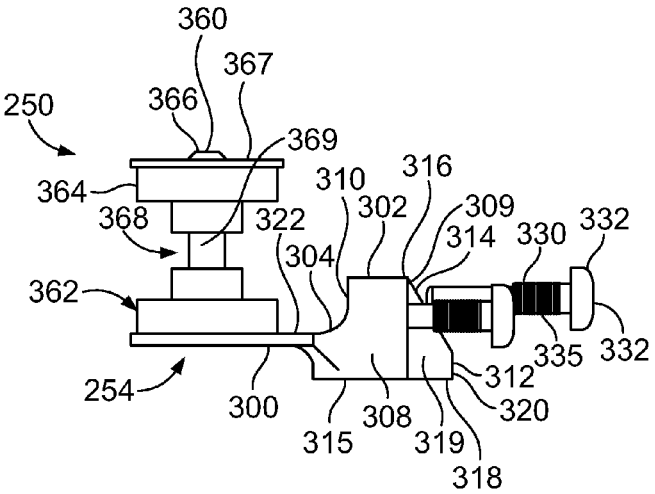
FIG. 5 illustrates a lateral view of a platform supporting adapter assembly, according to an embodiment of the present disclosure.
Figure 6:
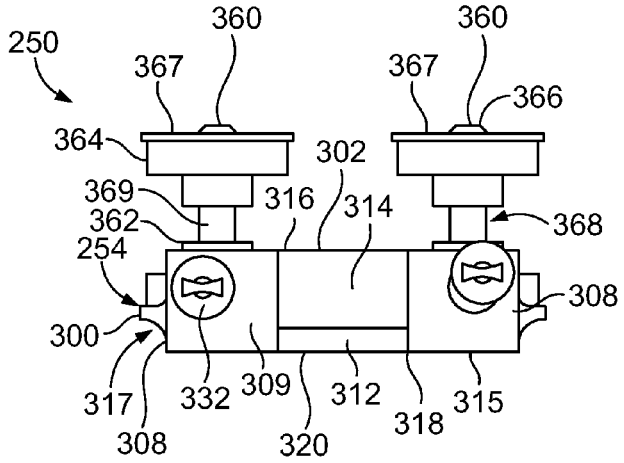
FIG. 6 illustrates an end view of a platform supporting adapter assembly, according to an embodiment of the present disclosure.

FIG. 3 illustrates a perspective top view of a platform supporting adapter assembly 250, according to an embodiment of the present disclosure. FIG. 4 illustrates a top view of the platform supporting adapter assembly 250. FIG. 5 illustrates a lateral view of the platform supporting adapter assembly 250. FIG. 6 illustrates an end view of the platform supporting adapter assembly 250.

Referring to FIGS. 3-6, the platform supporting adapter assembly 250 may include an adapter 254 having a planar panel 300. A connection block 302 upwardly extends from an end 304 of the panel 300. The connection block 302 includes through-holes 306 formed proximate to sides 308. Each through-hole 306 extends through the connection block 302 from a front surface 309 to a rear surface 310.

A central protuberance 312 extends outwardly from the front surface 309 between the through-holes 306. The central protuberance 312 may include ramp 314 that outwardly and downwardly angles from an upper edge 316 of the front surface 309 towards a lower edge 318 of the front surface 309. The ramp 314 may connect to a lower shoulder 320 that may be disposed within a plane that is parallel to the rear wall 310, which may be a flat planar surface that is perpendicular to an upper surface 322 of the panel 300. The shoulder 320 may be configured to seat on an upper surface of the flange 222 (shown in FIG. 2). The ramp 314 may be sized and shaped to fit within a reciprocal channel or area within another component, such as the RS 126 (shown in FIG. 1). Optionally, the central protuberance 312 may be sized and shaped differently than shown. For example, the central protuberance 312 may be a square block, a hemisphere, a pyramid, or the like.

Each of the through-holes 306 is configured to receive an elongated shank or shaft 330 of an elongated bolt 332, which is longer than the standard bolts 212 (shown in FIG. 2) that are used to secure the MGS 124 to the RS 126 (shown in FIG. 1). Each bolt 332 may include a head 334 that connects to the shaft 330. The shaft 330 may include a threaded portion 335 proximate to the head 334, and a tapered pin 336 extending axially outward from the threaded portion 335. The tapered pin 336 may taper down from a root 340 toward a distal tip 341 (shown in FIG. 4). The diameter of the tapered pin 336 is smaller than the diameter of the threaded portion 335. The diameter of the tapered pin 336 may progressively decrease from the root 340 to the distal tip. The threaded portion 335 may be configured to threadably engage a reciprocal threaded interface formed within a nut and/or a through-hole of a component, such as the through holes 210 of the MGS 124.

Base-securing fasteners 360 upwardly extend from the panel 300. As shown, the platform supporting adapter assembly 250 may include two base-securing fasteners 360. Each base-securing fastener 360 may include a bolt that extends into a recess (hidden from view) formed through the panel 300. A lower isolator 362 may circumferentially extend around a fastener 360 on the upper surface 322 of the panel 300. An upper isolator 364 may circumferentially extend around a fastener 360 proximate to a head 366. A washer 367 may be disposed between a lower surface of the head 366 and an upper surface of the upper isolator 364. The isolators 362 may be formed of silicone, rubber, other types of elastomeric materials, and/or the like and are configured to dampen vibrations. Accordingly, energy (for example, shocks, vibrations, and/or the like) transmitted from the MGS 124 into the isolators 362 and 364 is dampened, which reduces the impact of the energy into the testing instrumentation platform 200.

The lower isolator 362 is separated from the upper isolator 364 by a gap 368. As such, a shaft 369 of the fastener 360 is exposed within the gap 368. A portion of the base 260 of the testing instrumentation platform 200 (such as edge portions around a through hole), which is shown in FIG. 2, is configured to be sandwiched between the isolators 362 and 364 within the gap 368.

Alternatively, more or less bolts 332 and fasteners 360 than shown may be used. For example, a single bolt 360 may be used to secure the adapter 254 to a portion of a component. Also, alternatively, more or less isolators than shown may be used. In at least one embodiment, the platform supporting adapter assembly 250 may not include any isolators. In at least one other embodiment, the platform supporting adapter assembly 250 may include one isolator (such as either the lower or upper isolator 362 or 364).

Figure 7:
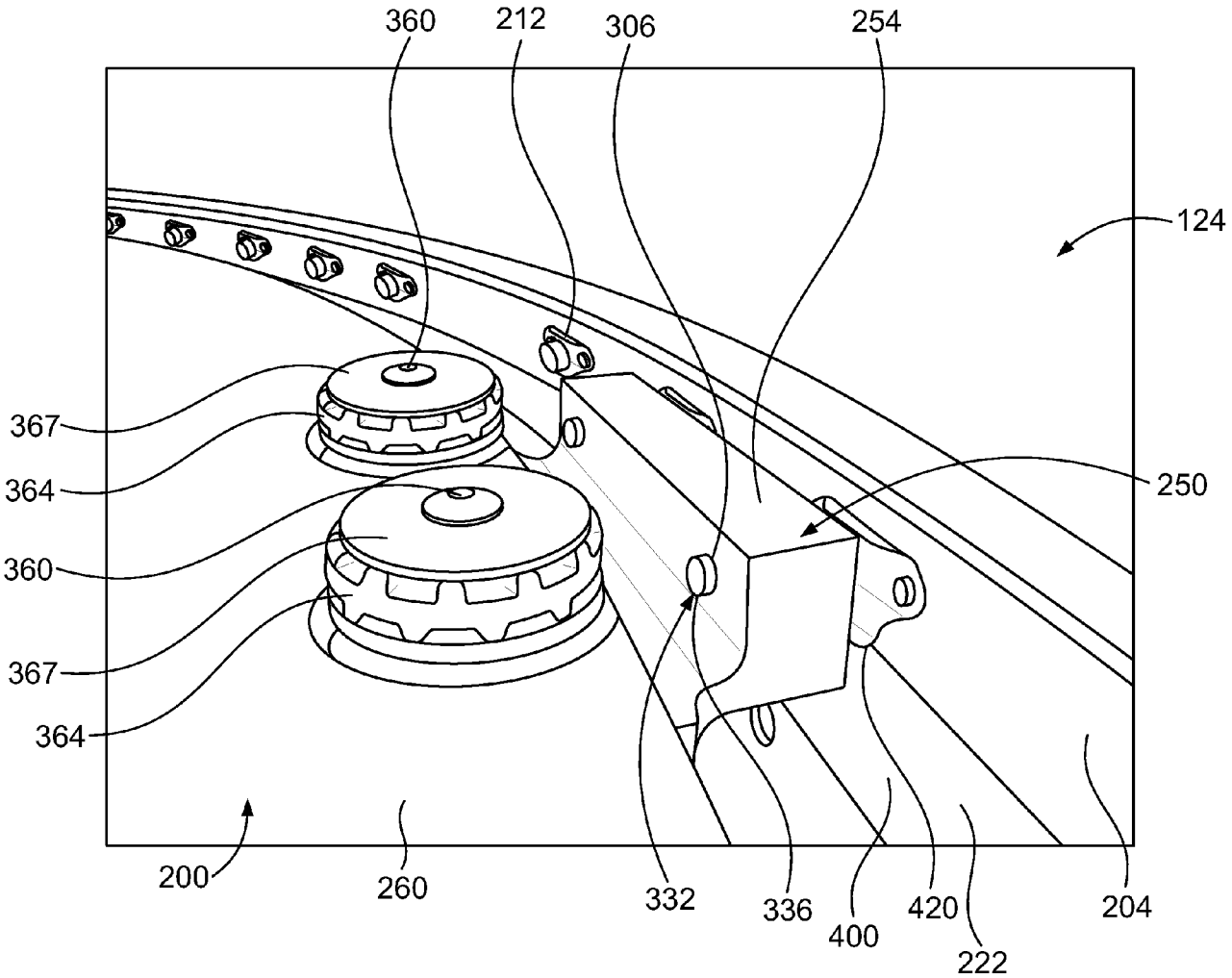
FIG. 7 illustrates a perspective top view of a platform supporting adapter assembly supporting a testing instrumentation platform within a missile guidance set, according to an embodiment of the present disclosure.

FIG. 7 illustrates a perspective top view of the platform supporting adapter assembly 250 supporting the testing instrumentation platform 200 within the MGS 124, according to an embodiment of the present disclosure. Referring to FIGS. 2 and 7, instead of the bolts 212, the elongated and tapered bolts 332 are positioned within through-holes 210, and securely connect the adapter 254 to the flange 222. A bottom surface 315 (shown in FIGS. 5 and 6) of the adapter 254 may seat on an upper surface 400 of the flange 222. Lateral channels 317 (shown in FIGS. 3-6) may be formed through portions of the bottom surface 315 to accommodate existing brackets 420 secured to the upper connection rim 204. The brackets 420 include openings and/or nuts that are configured to receive bolts 212, which may be removed, so that the brackets 420 may allow passage of the bolts 332. The threaded portions 335 (shown in FIGS. 3-5) may threadably engage portions of the brackets 420 (such as nuts) and/or the adapter to provide a threadably secure connection therewith. The tapered pins 336 pass into and through the through-holes 306 (which may have a conforming tapered shape), and act to lock the adapter 254 in place. The angle of the taper of each tapered pin locks the tapered pin 336 to the adapter 254.

The central protuberance 312 (shown in FIGS. 3-6) is sized and shaped to fit between neighboring (that is, closest) brackets 420. A flat lower surface of the shoulder 320 seats on the upper surface 400 of the flange 222, while sides 319 of the protuberance 312 abut into interior surfaces of the neighboring brackets 420, thereby automatically centering the platform supporting adapter assembly 250 and restraining or otherwise limiting radial shifting of the platform supporting adapter assembly 250 in relation to the MGS 124.

The fasteners 360 are used to securely connect the platform supporting adapter assembly 250 to the base 260 of the testing instrumentation platform 200. For example, the shafts of the fasteners 360 extend through holes formed in the base 260. The lower and upper isolators 362 and 364 sandwich edge portions of the base 260 that define the holes therebetween. The isolators 362 and 364 dampen vibratory or other such energy that may be transmitted from the MGS 124, for example. As such, the isolators 362 and 364 reduce a risk of vibration energy, for example, damaging components of the testing instrumentation platform 200. Moreover, the isolators 362 and 364 accommodate differences in tolerance, thereby allowing the testing instrumentation platform 200 to easily fit and connect to the platform supporting adapter assemblies 250.

Accordingly, the platform supporting adapter assemblies 250 may be used to secure the testing instrumentation platform 200 within one or more components of a missile system 100 (shown in FIG. 1), such as within the MGS 124. The component need not be modified to accommodate the testing instrumentation platform 200. Instead, certain standard bolts (such as the bolts 212) may be removed from the component (such as the MGS), and the elongated bolts 332 may replace the removed bolts to securely connect the platform supporting adapter assemblies 250 to the component. The base 260 of the testing instrumentation platform 200 may then be secured to the platform supporting adapter assemblies 250 as described above.

Referring to FIGS. 2-7, in order to secure the testing instrumentation platform 200 to the MGS 124, the testing instrumentation platform 200 may be lowered onto the MGS 124 such that an outer circumferential edge rests on the flange 222. The tapered bolts 332 may then be inserted through the through-holes 210 and into the aligned through-holes 306 of the adapter 254. The testing instrumentation platform 200 may vertically lift when the tapered bolts 332 engage the adapter 254. The testing instrumentation platform 200 is automatically centered and secured in place as the tapered bolts 332 are fully engaged (such as by portions of the base 206 being sandwiched between opposed isolators 362 and 364). The ramps 314 may be sized and shaped to fit within reciprocal features of another component, such as the RS 126 (shown in FIG. 1), thereby automatically aligning the testing instrumentation platform 200 to the RS 126.

As shown and described, the testing instrumentation platform 200 may mount within and/or between components of a missile system through the existing bolt interface(s) of the missile system. The platform supporting adapter assemblies 250 are used to securely connect the testing instrumentation platform 200 to the bolt interface(s) of one or more components of the missile system.

Figure 8:
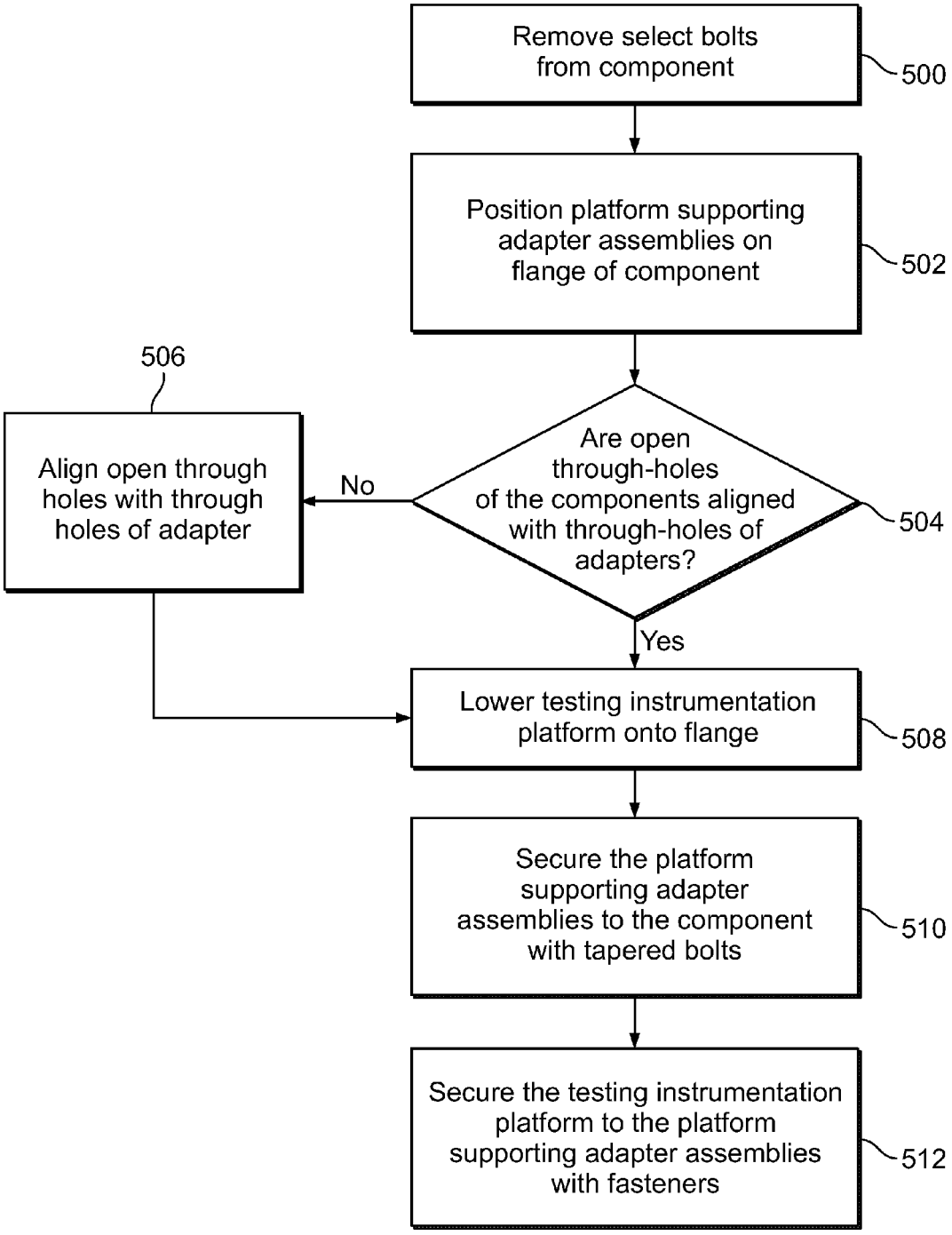
FIG. 8 illustrates a flow chart of a method of securely connecting a testing instrumentation panel to a component of a missile system, according to an embodiment.

FIG. 8 illustrates a flow chart of a method of securely connecting a testing instrumentation panel to a component (such as an MGS, PSRE, and/or RS) of a missile system, according to an embodiment. At 500, select standard bolts are removed from the component. Next, at 502, platform supporting adapter assemblies are positioned on a flange of the component. At 504, it is determined whether the open through-holes of the component (that is, the through-holes that previously accommodated the removed standard bolts) are aligned with through-holes of adapters of the platform supporting adapter assemblies. If not, then the method proceeds from 504 to 506, in which the open through-holes are aligned with the through holes of the adapter. If aligned, the method proceeds to 508, in which the testing instrumentation platform is lowered onto the flange of the component. Next, at 510, the platform supporting adapter assemblies are secured to the component with tapered bolts. At 512, the testing instrumentation platform is secured to the platform supporting adapter assemblies with fasteners. Steps 510 and 512 may occur at the same time. Optionally, step 512 may be performed before step 510.

As described above, embodiments of the present disclosure provide a method of quickly and efficiently securing an instrumentation platform or other such temporary flight test equipment to a missile system that may be easily adapted to an existing missile system with minimal design changes. Further, the instrumentation platform may be secured within one or more existing components of the missile system, thereby providing more reliable test data, as an outer mold line of the missile system is not changed. That is, a missile system being tested is the same size and shape as others that are not being tested, and will therefore perform more like the actual missile systems that are to be used at a later date.

The testing instrumentation platform may be completely enclosed by the one or more components of the missile system. For example, the testing instrumentation platform may be enclosed within one or more of the MGS, the PSRE, and/or the RS. As such, the missile system may be tested with an internal testing instrumentation platform that is completely enclosed by other components, instead of using a separate and distinct testing instrumentation stage that is stacked between two other components.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A missile system, comprising:

a plurality of components; and a testing instrumentation platform secured within at least one of the plurality of components, wherein the testing instrumentation platform is secured within the at least one of the plurality of components through at least one platform supporting adapter assembly that comprises:

an adapter having a planar panel that supports one or more fasteners, wherein the one or more fasteners are configured to securely connect to a portion of a base of the testing instrumentation platform;

at least one through-hole formed through a portion of the adapter; and at least one tapered bolt that is configured to be securely retained within the at least one through-hole, wherein the at least one tapered bolt securely connects the adapter to the at least one of the plurality of components.

2. The missile system of claim 1, wherein the at least one of the plurality of components comprises at least one of a missile guidance set (MGS), a propulsion system rocket engine (PSRE), or a reentry system (RS).

3. The missile system of claim 1, wherein the testing instrumentation platform is completely enclosed by the at least one of the plurality of components.

4. The missile system of claim of claim 1, further comprising a main assembly that includes at least one booster stage.

5. The missile system of claim 1, wherein the at least one platform supporting adapter assembly further comprises a connection block extending from a portion of the planar panel, wherein the at least one through-hole is formed through the connection block.

6. The missile system of claim 1, wherein the at least one platform supporting adapter assembly further comprises a central protuberance that is configured to align the at least one platform supporting adapter assembly with the at least one of the plurality of components.

7. The missile system of claim 6, wherein the central protuberance comprises a ramp connected to a shoulder.

8. The missile system of claim 1, wherein the at least one tapered bolt is longer than a standard bolt used to connect the at least one of the plurality of components to another of the plurality of components.

9. The missile system of claim 1, wherein the at least one tapered bolt comprises:

a head connected to a threaded portion; and a tapered pin extending from the threaded portion, wherein the tapered pin downwardly tapers from a root to a distal tip, wherein the tapered pin is configured to be received and locked within a reciprocally-shaped portion of the at least one through-hole.

10. The missile system of claim 1, wherein the at least one platform supporting assembly further comprises at least one isolator coupled to the at least one fastener, wherein a portion of the base of the testing instrumentation platform abuts the at least one isolator.

11. A platform supporting adapter assembly configured to securely support a testing instrumentation platform within one or more components of a missile system, the platform supporting adapter assembly comprising:

an adapter having a planar panel that supports one or more fasteners, wherein the one or more fasteners are configured to securely connect to a portion of a base of the testing instrumentation platform; and at least one tapered bolt that is configured to be securely retained within at least one through-hole formed through a portion of the adapter, wherein the at least one tapered bolt is configured to securely connect the adapter to the one or more components.

12. The platform supporting adapter assembly of claim 11, wherein the at least one platform supporting adapter assembly further comprises a connection block extending from a portion of the planar panel, wherein the at least one through-hole is formed through the connection block.

13. The platform supporting adapter assembly of claim 11, wherein the at least one platform further comprises a central protuberance that is configured to align the platform supporting adapter assembly with the one or more components.

14. The platform supporting adapter assembly of claim 13, wherein the central protuberance comprises a ramp connected to a shoulder.

15. The platform supporting adapter assembly of claim 11, wherein the at least one tapered bolt is longer than a standard bolt used to connect at least two components of the missile system together.

16. The platform supporting adapter assembly of claim 11, wherein the at least one tapered bolt comprises:

a head connected to a threaded portion; and a tapered pin extending from the threaded portion, wherein the tapered pin downwardly tapers from a root to a distal tip, wherein the tapered pin is configured to be received and locked within a reciprocally-shaped portion of the at least one through-hole.

17. The platform supporting adapter assembly of claim 11, further comprising at least one isolator coupled to the at least one fastener.

18. A platform supporting adapter assembly configured to securely support a testing instrumentation platform within one or more components of a missile system, the platform supporting adapter assembly comprising:

an adapter having a planar panel that supports two fasteners, wherein each of the two fasteners is configured to securely connect to a portion of a base of the testing instrumentation platform;

lower and upper isolators coupled to the each of the two fasteners, wherein the portion of the base is sandwiched between the lower and upper isolators;

a connection block extending from a portion of the planar panel, wherein two through-holes are formed through the connection block;

a central protuberance outwardly extending from the connection block, wherein the central protuberance comprises a ramp connected to a shoulder, wherein the central protuberance is configured to align the platform supporting adapter assembly with the one or more components; and two tapered bolts that are securely retained within the two through-holes, wherein the two tapered bolts are configured to securely connect the adapter to the one or more components, wherein each of the two tapered bolts is longer than a standard bolt used to connect at least two components of the missile system together, wherein each of the two tapered bolts comprises: (a) a head connected to a threaded portion, and (b) a tapered pin extending from the threaded portion, wherein the tapered pin downwardly tapers from a root to a distal tip, wherein the tapered pin is configured to be received and locked within a reciprocally-shaped portion of one of the two through-holes.

* * * * *